US007090597B2

(12) United States Patent
Berghash et al.

(10) Patent No.: US 7,090,597 B2
(45) Date of Patent: Aug. 15, 2006

(54) HAND SHIELD FOR HOCKEY STICK

(75) Inventors: Robert Berghash, Williamsville, NY (US); Jefrey Frost, LaBelle, FL (US)

(73) Assignee: Shield Mfg. Inc., Tonawanda, NY (US)

( * ) Notice: Subject to any disclaimer, the term of this patent is extended or adjusted under 35 U.S.C. 154(b) by 0 days.

(21) Appl. No.: 10/665,539

(22) Filed: Sep. 19, 2003

(65) Prior Publication Data

US 2005/0064960 A1 Mar. 24, 2005

(51) Int. Cl.
*A63B 69/00* (2006.01)

(52) U.S. Cl. ..... 473/446; 473/422; 473/458

(58) Field of Classification Search ..... 473/422, 473/463, 464, 459, 458, 451, 505, 516, 518, 473/538, 560, 568; 2/17
See application file for complete search history.

(56) References Cited

U.S. PATENT DOCUMENTS

| | | | | | |
|---|---|---|---|---|---|
| 340,513 | A * | 4/1886 | Lowther | 2/17 |
| 416,849 | A * | 12/1889 | Neale | 2/17 |
| 838,105 | A * | 12/1906 | Grant | 463/47.1 |
| 1,096,204 | A * | 5/1914 | Taggart | 2/17 |
| 1,687,736 | A * | 10/1928 | Root | 473/560 |
| 1,835,719 | A * | 12/1931 | Parr | 426/134 |
| 2,132,570 | A * | 10/1938 | Leone | 2/17 |
| 2,294,026 | A * | 8/1942 | De Tuscan | 482/1 |
| 2,436,507 | A * | 2/1948 | Ellwood | 2/17 |
| 2,497,749 | A * | 2/1950 | Wagner | 2/16 |
| 2,755,477 | A * | 7/1956 | Hubbman | 2/17 |
| 2,803,087 | A * | 8/1957 | Zalkind | 446/473 |
| 2,957,208 | A * | 10/1960 | Gardner et al. | 264/46.4 |
| 2,998,974 | A * | 9/1961 | Stafford | 463/47.1 |
| 3,037,320 | A * | 6/1962 | Powell | 446/473 |
| 3,940,134 | A * | 2/1976 | Bieganowski | 473/560 |
| 4,052,059 | A * | 10/1977 | Rigsby | 473/560 |
| 4,351,528 | A * | 9/1982 | Duplin | 473/560 |
| 4,683,592 | A * | 8/1987 | Strongwater | 2/17 |
| 5,029,898 | A * | 7/1991 | Grignon et al. | 280/821 |
| 5,456,463 | A * | 10/1995 | Dolan et al. | 473/563 |
| 5,816,961 | A * | 10/1998 | Kraemer | 473/560 |
| 6,113,508 | A * | 9/2000 | Locarno et al. | 473/516 |
| 6,752,730 | B1 * | 6/2004 | Brine et al. | 473/513 |
| 2004/0138012 | A1 * | 7/2004 | Tyler | 473/446 |

FOREIGN PATENT DOCUMENTS

GB 2256150 A * 12/1992

OTHER PUBLICATIONS

U.S. Appl. No. 60/438,745 to Tyler, filed Jan. 8, 2003.*

* cited by examiner

*Primary Examiner*—Mitra Aryanpour
(74) *Attorney, Agent, or Firm*—Phillips Lytle LLP

(57) ABSTRACT

The present invention provides a hand shield (10) adapted for use with a hockey stick. The hand shield includes a flexible shield portion (11) having a convex outer surface (12) and an opening configured to accommodate a portion of a hockey stick. The hand shield further comprises an interior grip portion extending away from the shield portion and configured so as to slidably embrace a hockey stick. In one aspect, the interior grip portion includes four generally parallel flexible tabs (15, 16, 17, 19) which align with the four sides of a rectangular hockey stick.

8 Claims, 2 Drawing Sheets

HAND SHIELD FOR HOCKEY STICK

TECHNICAL FIELD

The present invention relates generally to hockey equipment and, more particularly, to a hand shield adapted for use with a hockey stick to protect players' hands and fingers.

BACKGROUND ART

The nature of the sport of hockey is such that fast moving pucks and balls, sticks and other equipment, as well as collisions between participants, can result in injuries if appropriate protective gear is not utilized. In ice hockey, relatively expensive hockey gloves are often used to protect players' hands and fingers from flying pucks and slashing sticks. In street hockey, roller hockey, school gym hockey programs and other off-ice hockey games, however, players often do not wear protective gloves. This may be due to cost, inconvenience or a lack of available equipment, for example. Oftentimes, therefore, in the normal course of a hockey game, players clash with other players, sticks collide with other sticks, and sticks strike players' fingers and hands.

There is a need, therefore, for an inexpensive alternative to protective hockey gloves which hockey players may use to protect their hands and fingers.

DISCLOSURE OF THE INVENTION

With parenthetical reference to the corresponding parts, portions or surfaces of the disclosed embodiment, merely for purposes of illustration and not by way of limitation, the present invention provides a flexible hand shield (10) adapted for use with a hockey stick. As used herein, the hand shield is intended to be a separate and distinct invention from hockey sticks with which it is intended to be used.

In one aspect of the invention, the hand shield comprises a flexible shield portion (11) having a convex outer surface (12). The flexibility of the shield portion provides comfort for a player's hand when inserted into the hand shield. This aspect of the invention further comprises an opening (18) in the flexible shield portion configured to accommodate portions of a hockey stick that may be passed through the opening. The opening in one aspect of the invention is configured such that a hockey stick with an end cap, butt end or taped end is capable of passing through the opening. Therefore, hockey sticks without removable butt ends may fit through the opening.

Another aspect of the invention provides an interior grip portion connected to the shield portion extending away from the shield portion. In this aspect, the interior grip portion is configured so as to slidably embrace a hockey stick.

In another aspect of the invention, the interior grip portion extends away from the perimeter (13) of the opening in the flexible shield portion. In another aspect of the invention, the interior grip portion comprises a plurality of generally parallel flexible tabs or flaps (15, 16, 17, 19). In one aspect of the invention, four such tabs correspond to or align with the four sides of a rectangular hockey stick when such a hockey stick is passed through the hand shield. In that aspect, the planes of first and second tabs are parallel, while the planes of third and fourth tabs are parallel and perpendicular to the planes of the first two tabs.

In another aspect of the invention, the opening (18) in the flexible shield portion is generally rectangular. In another aspect, the opening is configured so as to accommodate multiple cross-sectional configurations of hockey sticks. Such configurations include, but are not limited to, rectangular, polygonal, circular and oval cross-sections. In another aspect of the invention, the perimeter of the opening in the flexible shield portion is itself flexible. In another aspect, the perimeter is sufficiently flexible and/or configured so as to allow a hockey stick without a removable butt end—that is, with a fixed butt end—to pass through the opening.

In other aspects of the invention, the hand shield further comprises a hockey stick and, in another aspect, the hockey stick comprises a shaft and a blade.

The general object of the invention is to provide protection to hockey players and, more particularly, to protect their hands and fingers from pain and injury.

Another object of the present invention is to provide a less expensive alternative to hockey gloves for use in, among other things, street hockey, roller hockey, school gym hockey and other off-ice hockey games.

These and other objects and advantages will become apparent from the foregoing and ongoing written specification, the accompanying drawings and the appended claims.

DESCRIPTION OF THE PREFERRED EMBODIMENTS

Figure 1:
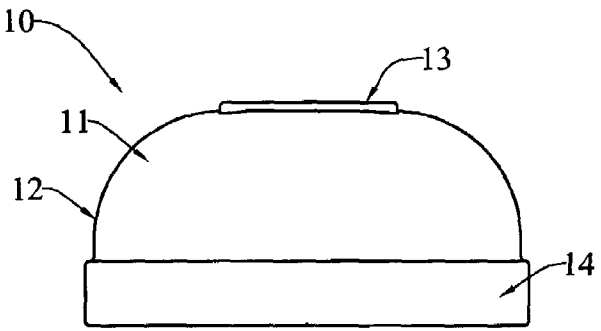
FIG. 1 is a side view of the hand shield of the present invention.

At the outset, it should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. Unless otherwise indicated, the drawings are intended to be read together with the specification, and are to be considered a portion of the entire written description of this invention. As used in the following description, the terms "horizontal", "vertical", "left", "right", "up" and "down", as well as adjectival and adverbial derivatives thereof(e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring now to the drawings, the present invention provides an improved hand shield 10 adapted for use with a hockey stick. FIG. 1 is a side view of the hand shield which illustrates the flexible shield portion 11 of the invention which has a convex outer surface 12. The shield portion is designed to protect a player's hands and fingers but not to extend so far as to interfere with play. In this embodiment, the flexible shield portion has an opening 18 with a raised perimeter 13 and an annular rim 14 extending around the bottom marginal end portion of the flexible shield portion. In other embodiments, the flexible shield portion may not include a rim portion or a raised perimeter for the opening.

This flexible shield portion may be made from many different materials including, but not limited to, low density polyethylene, vinyl, ethylene vinyl acetate, sanoprene, rubber, etc.

Figure 2:
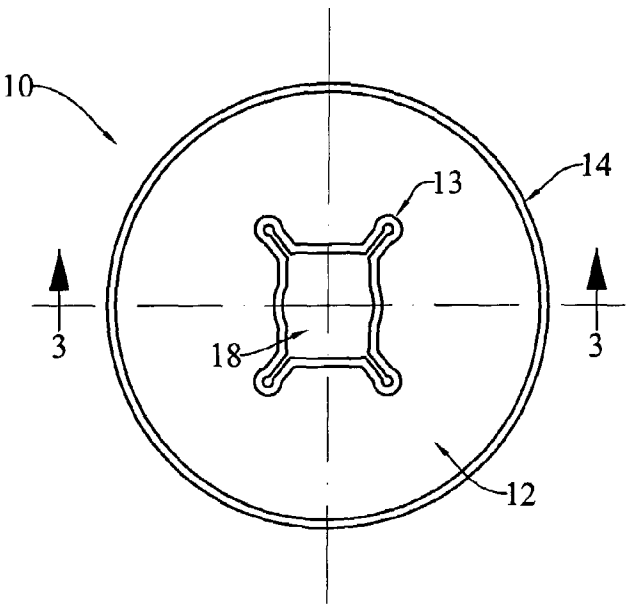
FIG. 2 is a top view of the hand shield of the present invention.

FIG. 2 further illustrates the flexible shield portion of the invention and the opening 18 in that portion. The opening in this embodiment, which is configured to accommodate a portion of a hockey stick that may be passed through the opening, is generally rectangular in shape. The two longer sides of the rectangle, however, include an outwardly rounded center portion which provides greater flexibility and/or accommodates hockey sticks with, among other things, round or oval cross-sections. In this embodiment, the raised perimeter 13 of the opening, and the corresponding opening 18, extend outwardly from the four corners of the generally rectangular opening, as illustrated in FIG. 2, to provide additional flexibility and to allow for hockey sticks of various shapes and sizes to pass through the opening, including rectangular and other polygonal cross-sectional sticks, as well as circular, generally circular or oval cross-sectional sticks.

Figure 3:
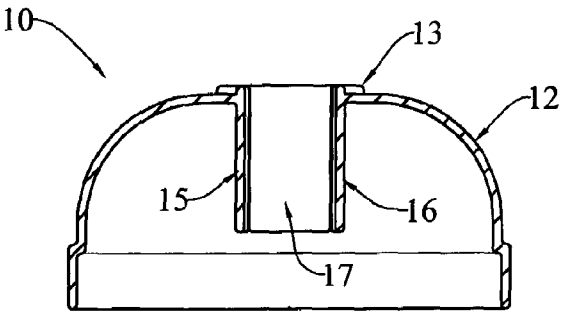
FIG. 3 is a cross-sectional view of the hand shield of the present invention.
Figure 4:
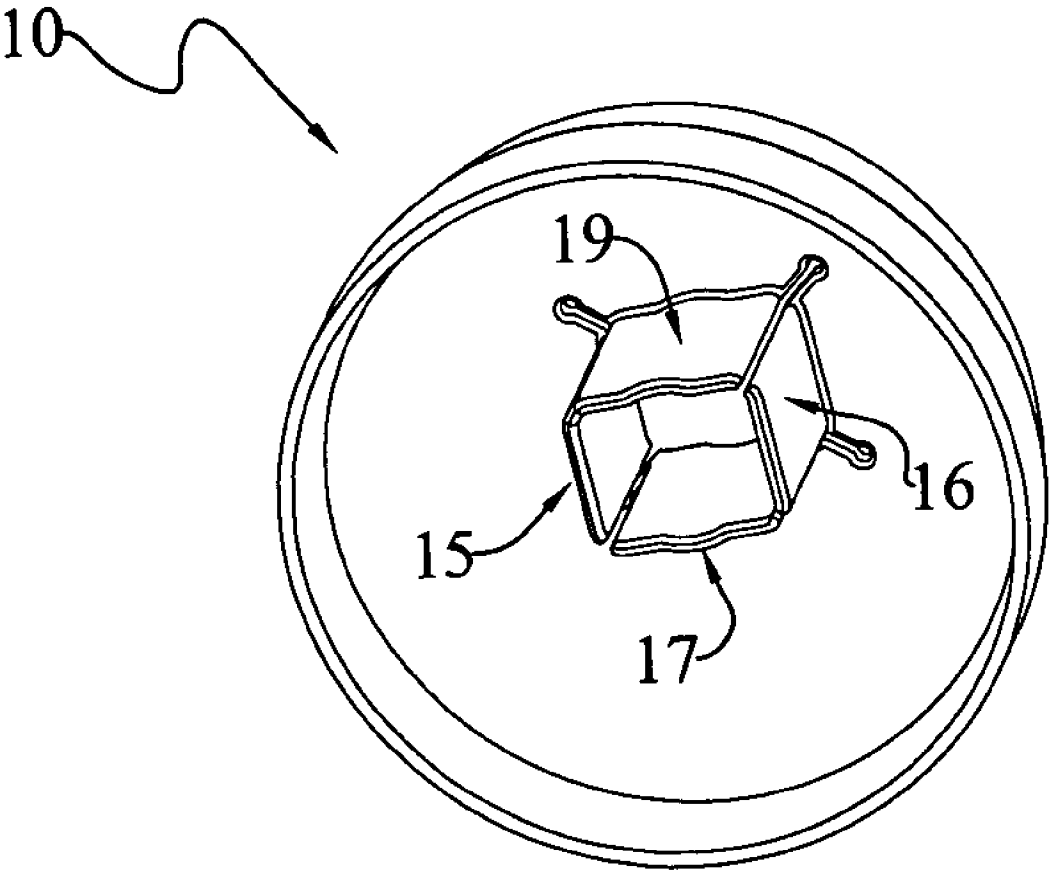
FIG. 4 is a perspective view of the hand shield of the present invention illustrating an interior grip portion.

FIG. 3 is a cross-section of the hand shield of the present invention which illustrates the convex surface of the flexible shield portion 11 and the raised perimeter 13 of the opening. FIG. 3 further illustrates a preferred embodiment of the interior grip portion 15, 16, 17 of the present invention. FIG. 3 depicts a cross-section of first and second generally parallel tabs, flaps or grip portions 15, 16 extending away from the flexible shield portion 11 and into the interior space defined by the surface of the shield portion. These tabs are connected to the shield portion. A third tab 17 extends away from the flexible shield portion on a plane perpendicular to the other tabs 15, 16. In this preferred embodiment, a total of four tabs extend away from this shield portion and define a generally rectangular area through which a hockey stick may be passed. A fourth tab 19, which is shown in FIG. 4, is generally identical to the third tab 17. The planes of the third tab 17 and fourth tab 19 are generally parallel. The tabs are flexible, and the hand shield may slide up and down the shaft of a hockey stick with which it is used, during the normal course of a hockey game. In addition, this flexibility allows a hockey player to exert pressure on the tabs of the interior grip portion, typically with the thumb and index finger, thereby holding the hand shield in place with respect to a hockey stick shaft. The hand with which a hockey player grasps the interior grip portion—the left hand for a right-handed shooter, and vice versa—remains on the stick for much of the period of play. A player's other hand may grasp the hockey stick shaft directly, and is frequently removed from the shaft. The use of the hand shield also may require a player to use the proper grip on the shaft and, therefore, serves as a training aid.

While there has been described what is believed to be the preferred embodiment of the present invention, those skilled in the art will recognize that other and further changes and modifications may be made thereto without departing from the spirit of the invention. For example, the shape of the shield portion may be varied, as well as the shape of the opening and the construction and configuration of the grip portion. In another example, a single-piece construction may be used in place of the tabs as described. Such a single-piece construction may include ribs or ridges to provide flexibility and the other advantages of the tabs as described herein. Therefore, the invention is not limited to the specific details and representative embodiments shown and described herein. In the following claims, preamble language that is not specifically referred to in the body of a particular claim is to be construed as a mere statement of intended use and not as a limitation. Accordingly, various modifications may be made without departing from the spirit or scope of the general inventive concept as defined and differentiated by the following claims.

What is claimed is:

1. A hand shield adapted for use with a hockey stick, comprising:

a hockey stick;

a flexible shield portion having a convex outer surface, a substantially concave inner surface configured to shield all or part of a hand, and a first opening in said shield portion configured to accommodate a portion of said hockey stick that is passed therethrough; and an interior grip portion comprising a proximal end portion connected to said shield portion, said interior grip portion extending away from the perimeter of said first opening and configured so as to slidably embrace said hockey stick and adapted for gripping by all or part of a hand, wherein said interior grip portion comprises a distal end portion which defines a second opening, and said hand shield is configured such that said hockey stick is passed through each of said first and second openings.

2. The hand shield as set forth in claim 1 wherein said interior grip portion comprises a plurality of generally parallel flexible tabs.

3. The hand shield as set forth in claim 1 wherein said first opening is generally rectangular.

4. The hand shield as set forth in claim 1 wherein said first opening is configured so as to accommodate multiple cross-sectional configurations of said hockey stick.

5. The hand shield as set forth in claim 4 wherein said configurations are a rectangular cross-section, a polygonal cross-section, a circular cross-section and an oval cross-section.

6. The hand shield as set forth in claim 1 wherein said hockey stick has a fixed butt end, wherein the perimeter of said first opening is configured such that said hockey stick is may-be passed through said opening.

7. The hand shield as set forth in claim 1 wherein the perimeter of said first opening is flexible.

8. The hand shield as set forth in claim 1 wherein said hockey stick comprises a shaft and a blade.

* * * * *